US006206516B1

(12) United States Patent
Moriyama et al.

(10) Patent No.: US 6,206,516 B1
(45) **Date of Patent: *Mar. 27, 2001**

(54) INK JET RECORDING METHOD, INK JET RECORDING APPARATUS AND PRINTED PRODUCT

(75) Inventors: Jiro Moriyama, Kawasaki; Hiroshi Tajika; Toshiharu Inui, both of Yokohama; Yutaka Kurabayashi, Tokorozawa; Hitoshi Sugimoto, Yokohama; Kiichiro Takahashi; Fumihiro Gotoh, both of Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/448,319

(22) Filed: May 23, 1995

(30) Foreign Application Priority Data

May 23, 1994 (JP) ..... 6-108201
Apr. 28, 1995 (JP) ..... 7-105622

(51) Int. Cl.[7] ..... B41J 2/01
(52) U.S. Cl. ..... 347/101
(58) Field of Search ..... 347/101, 98

(56) References Cited

U.S. PATENT DOCUMENTS

| | | | | |
|---|---|---|---|---|
| 4,046,074 | * | 9/1977 | Hochberg | 347/101 |
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. . | |
| 4,538,160 | * | 8/1985 | Uchiyama | 345/95 |
| 4,558,333 | | 12/1985 | Sugitani et al. . | |
| 4,608,577 | | 8/1986 | Hori . | |
| 4,723,129 | | 2/1988 | Endo et al. . | |
| 4,740,796 | | 4/1988 | Endo et al. . | |
| 5,142,374 | | 8/1992 | Tajika et al. | 358/298 |
| 5,181,045 | | 1/1993 | Shields et al. . | |
| 5,338,597 | | 8/1994 | Kurabayashi et al. | 428/195 |
| 5,917,519 | * | 6/1999 | Arai et al. | 347/41 |

FOREIGN PATENT DOCUMENTS

| | | | |
|---|---|---|---|
| 0137313A1 | 4/1985 | (EP) . | |
| 0455389A1 | 11/1991 | (EP) . | |
| 54-56847 | 5/1979 | (JP) . | |
| 56-84992 | 7/1981 | (JP) . | |
| 59-123670 | 7/1984 | (JP) . | |
| 59-138461 | 8/1984 | (JP) . | |
| 60-71260 | 4/1985 | (JP) . | |
| 61-32757 * | 2/1986 | (JP) | 347/98 |
| 64-63185 | 3/1989 | (JP) . | |

* cited by examiner

*Primary Examiner*—David F. Yockey
*Assistant Examiner*—Michael Brooke
(74) *Attorney, Agent, or Firm*—Fitzpatrick, Cella, Harper & Scinto

(57) ABSTRACT

A recording method includes the steps of ejecting ink onto a recording material on the basis of image data; and ejecting record quality improving liquid to improve a record quality of the ink ejected onto the recording material; wherein one of the ink ejecting step and the liquid ejecting step is carried out after the other; the liquid ejecting step ejects the liquid to a part of an ink-ejection-area on the recording material to provide liquid-ejection-area and non-liquid-ejection-area.

25 Claims, 12 Drawing Sheets

YELLOW
RED
BLACK

Y

M

C

Bk

S

Y

M

C

Bk

S

Y

M

C

Bk

S

Y

M

C

Bk

S

INK JET RECORDING METHOD, INK JET RECORDING APPARATUS AND PRINTED PRODUCT

FIELD OF THE INVENTION AND RELATED ART

The present invention relates to an ink jet recording method which forms characters and/or images by means of ejecting ink droplets onto the recording medium, an ink jet recording apparatus, and printed products, in particular, an ink jet recording technology by witch dye or color material in the ink on the recording medium is rendered insoluble or is caused to aggregate.

The ink jet recording method is widely used in printers, copying machines, facsimiles, and the like because of its advantages such as low noise, low running cost, ease of size reduction, ease of colorization, and the like.

In order to produce water resistant, nonbleeding color images with highly developed color sing a conventional ink jet recording, it is necessary to use a dedicated paper which comprises a water resistant ink absorbing layer. In recent years, due to improvement in the ink, reasonably practical printing methods usable with plain paper have been developed, which is used with the printers, copying machines, or the like by a large quantity. However, the quality of the print produced on the plain paper still remains at an unsatisfactory level.

As for methods for improving the water resistant property or the water resistance of the images by means of improving the ink, one of the known methods is to give water resistance to the color material within the ink. Basically, the ink used with this method is rendered hard to re-dissolve in the water once it dries. Therefore, it suffers from the problem that it is liable to clog the recording head nozzles. It is not impossible to prevent this problem, but the prevention itself creates another problem in that the apparatus structure becomes rather complicated.

A Japanese Laid-Open Patent Application No. 84,992/1981 discloses a method in which the recording medium is coated in advance with material capable of fixing the dye. However, this method requires the use of a dedicated recording medium, and also, in order to coat the dye fixing material, the apparatus size becomes large, mating cost increase inevitable. In addition, it is rather difficult to coat the recording medium with the material capable of fixing the dye stably, by a predetermined thickness.

Further, another Japanese Laid-Open Patent Application No. 63,185/1989 discloses an art for adhering colorless ink, which is capable of rendering the dye insoluble, onto the recording medium with the use of an ink jet recording head. According to this method, the dot diameter of the colorless ink is set to be larger than that of the real ink, therefore, the desired properties can be satisfactorily obtained even when the landing or shot spots for the image producing ink and colorless ink are slightly deviated from each other However, this method shoots the colorless ink over the entire region upon which the images are formed; therefore, it suffers from the problem that the consumption of the colorless ink becomes large, inviting thereby the cost increase. Also, since a larger amount of the ink than usual is injected into the recording medium, a further problem is created in that it takes a longer time for the ink to dry, and the landing points of the ink are liable to be displaced due to the recording material cockling which occurs as the ink adhered to the recording medium and dries there. In particular, when the color images are formed, there is a problem that this landing point displacement caused by the cockling leads to color irregularity, which greatly deteriorates the image quality.

Another ink jet recording method, in which desired images are recorded by ejecting the ink from nozzles onto the recording medium with the function of pressure, electrical voltage, or the like, is recorded in U.S. Pat. No. 4,538,160, which is characterized in that the desired images are recorded twice in an overlaying manner, first with the actual recording ink and then, with processing ink capable of improving the picture quality, preservability, spreadability, and the like.

As for the structure of a recording apparatus to be used to carry out this recording method, signals supplied from an image signal control circuit for ejecting the inks of different color, that is, yellow, magenta, cyan, and black, are also supplied to a delay circuit through an OR circuit at the same time, being thereby supplied to a head which ejects the processing ink. However, according to this invention, the processing ink is ejected over the entire surface of the recorded desired image, that is, the entire surface on which the recording ink is ejected; therefore, the consumption of the processing ink is large. In other words, a large amount of the processing ink adheres to the recording medium; therefore, the recording medium is liable to suffer from cockling.

SUMMARY OF THE INVENTION

The present invention was made in consideration of the above mentioned problems, and its primary object is to provide an ink jet recording method, an ink jet recording apparatus, and print products, which can give to recorded images better water resistance than the conventional method even when plain paper is used; which makes it difficult for feathering (ink bleeding in the direction of the fiber in the recording medium) to occur; which produces high density images; which in the case of color recording, prevents inter-color bleeding, producing thereby high quality images; which reduces the consumption of the recording properties improving liquid, economizing thereby the recording.

Another object of the present invention is to provide a recording method comprising steps of:

- ejecting the ink onto the recording medium on the basis of image data; and
- ejecting the recording properties improving liquid onto the recording medium so that the recording properties of the ink to be ejected onto the recording medium s improved;
- wherein one of said steps of ejecting ink and ejecting the recording properties improving liquid is carried out ahead of the other, which is carried out thereafter; and
- during the step in which the recording properties improving liquid is ejected, said recording properties improving liquid is discriminately ejected onto the recording medium surface onto which the ink is to be ejected, so that some portions thereof are exposed to the liquid and the others are not.

Another object of the present invention is to provide a recording apparatus employing a head for ejecting the ink onto the recording medium, on the basis of the image data, and a head for ejecting the recording properties improving liquid onto the recording medium so as to improve the recording properties of the ink ejected onto the recording medium, comprising:

- ejection point data establishing means for establishing the ejection point data on the basis of the image data, so that the recording properties improving liquid is discriminately ejected onto the recording medium surface onto which the ink is to be ejected, in such a manner that some portions of the recording medium surface are covered with the recording properties improving liquid and the others are not; and driving signal supplying means for supplying driving signals to the head for recording properties improving liquid, on the basis of the ejection point data established by the ejection point data establishing means.

Another object of the present invention is to provide printed products comprising:

recording medium; and an image area formed on said recording medium with the ink;

wherein said image area comprises portions where the ink coexists with the ingredients for improving the recording properties of the ink on the recording medium, and portions where the ink exists without the presence of such ingredients.

According to an aspect of the present invention, it is conceivable that there are the following ink combinations; black ink alone; yellow, magenta, cyan, and black inks; yellow, magenta and cyan inks; and also, these color inks and other specific color ink or color inks, wherein the ejection data for the recording properties improving liquid is established on the basis of the ejection data for these inks that is, the image data.

According to another aspect of the present invention, it is possible to eject only a minimum necessary amount of the recording properties improving liquid; therefore, the water resistance of the images on the plain paper can be improved without deteriorating the image quality.

According to an aspect of the ink jet printing method of the present invention, color inks containing color material, and colorless or virtually colorless recording properties improving liquid containing ingredients for rendering the ink ingredients insoluble or aggregating them, are ejected onto the recording medium, wherein the ink and recording properties improving liquid mix and/or react to each other Lo give the recorded images the water resistance so that reliable high quality images can be obtained.

In this embodiment, improving the print properties includes: improving image quality such as density, saturation, degree of edge sharpness, dot diameter, and the like; improving the fixity of the ink, and improving the preservability of the image, that is, the environment resistance such as the water resistance or light resistance. The print properties improving liquid includes: liquid capable of rendering insoluble the dyes within the ink; liquid capable of destroying pigment dispersion; liquid for improving the print properties; and the like. The terminology "rendering insoluble" refers to a phenomenon that an anionic radical contained within the ink and a cationic radical of the cationic substance contained within the print properties improving liquid react to each other, being thereby ionicly bonded, whereby the dye having been uniformly dissolved within the ink separates from the solution. It should be noted here that such effects of the present invention as the suppression of color bleeding and the improvement in color development, character quality, and fixity can be obtained even when not all of the dye in the ink is rendered insoluble. As for the terminology "aggregation or coagulation" it is used in the same meaning as "rendering or making insoluble" when the coloring agent in the ink is water soluble dye containing anionic radical, and also, it includes a phenomenon that, when the coloring agent in the ink is pigment, the pigment dispersing agent or pigment surface ionicly reacts with the cationic radical of the cationic substance contained in the print properties improving liquid, destroying pigment dispersion, and subsequently, increasing the pigment diameter. Normally, as the aggregation occurs, ink viscosity increases. It is also to be noted here that such effects of the present invention as the suppression of color bleeding aid the improvement in color development, character quality, and fixity can be obtained even when not all of the pigment or pigment dispersing agent within the ink aggregates.

Those and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
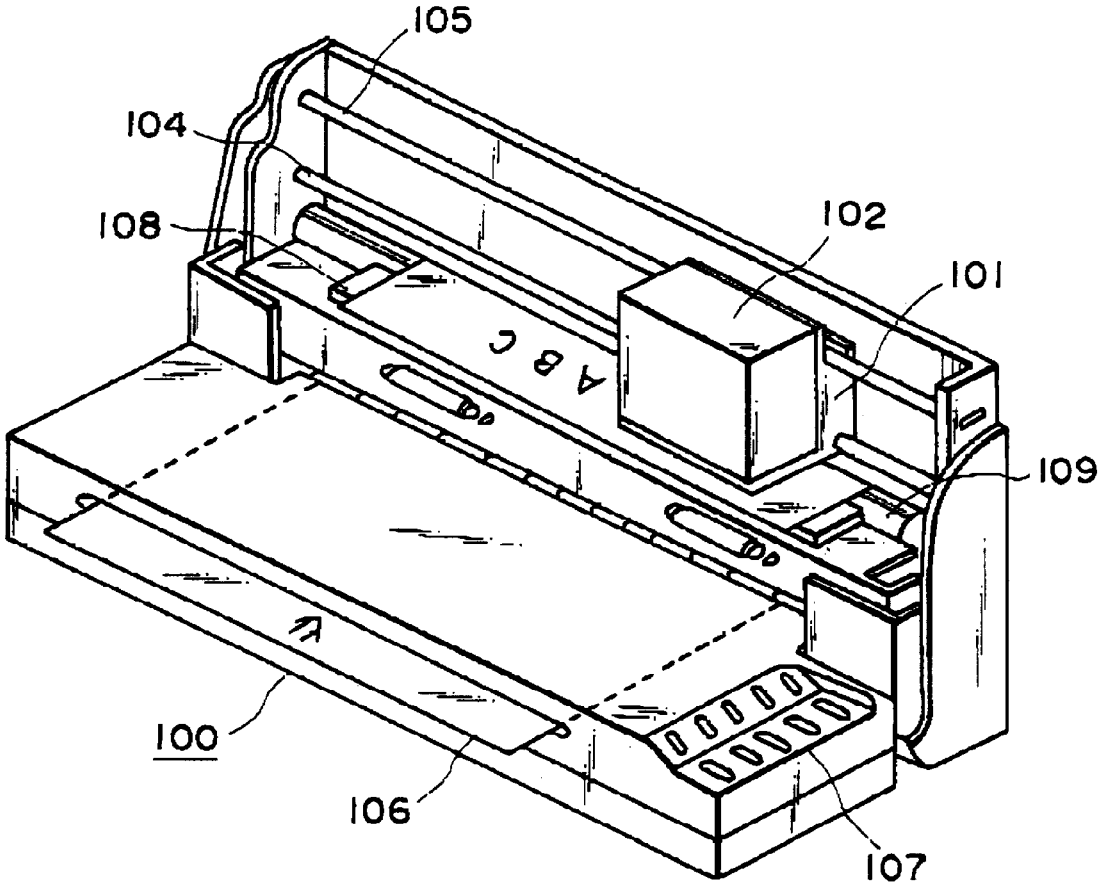
FIG. 1 is a schematic perspective view of an ink jet recording apparatus.

Hereinafter, preferred embodiments of the present invention will be described in detail referring to the drawings.

Embodiment

FIG. 1 is a schematic view of the structure of a recording apparatus used to carry out the recording method in accordance with the present invention. In the following descriptions, the recording properties improving liquid in accordance with the present invention will be referred to as "S liquid".

Referring to FIG. 1, a recording head 102 is enabled to eject five color liquids (inks): yellow (Y), magenta (M), cyan (C), and black (D3 k) inks, and colorless (S) liquid. A recording medium 106 fed into a recording apparatus 100 is delivered to a recording station of the recording head by a feeding roller 109 Underneath the recording region of the recording medium 106, a flat platen 108 is disposed. A carriage 101 is movable in the side to side direction of the drawing by a pair of guide shafts 104 and 105, scanning the recording region reciprocally. As the carriage 101 reciprocally scans the recording region, character images such as A, B and C, and/or the other images are recorded on the recording medium 106. A control panel 107 comprising a group of switches and a group of display panels is used to set various recording modes, and also, to display the recording apparatus conditions.

Figures 2A, 2B, 2C, 2D, 2E, 2F:
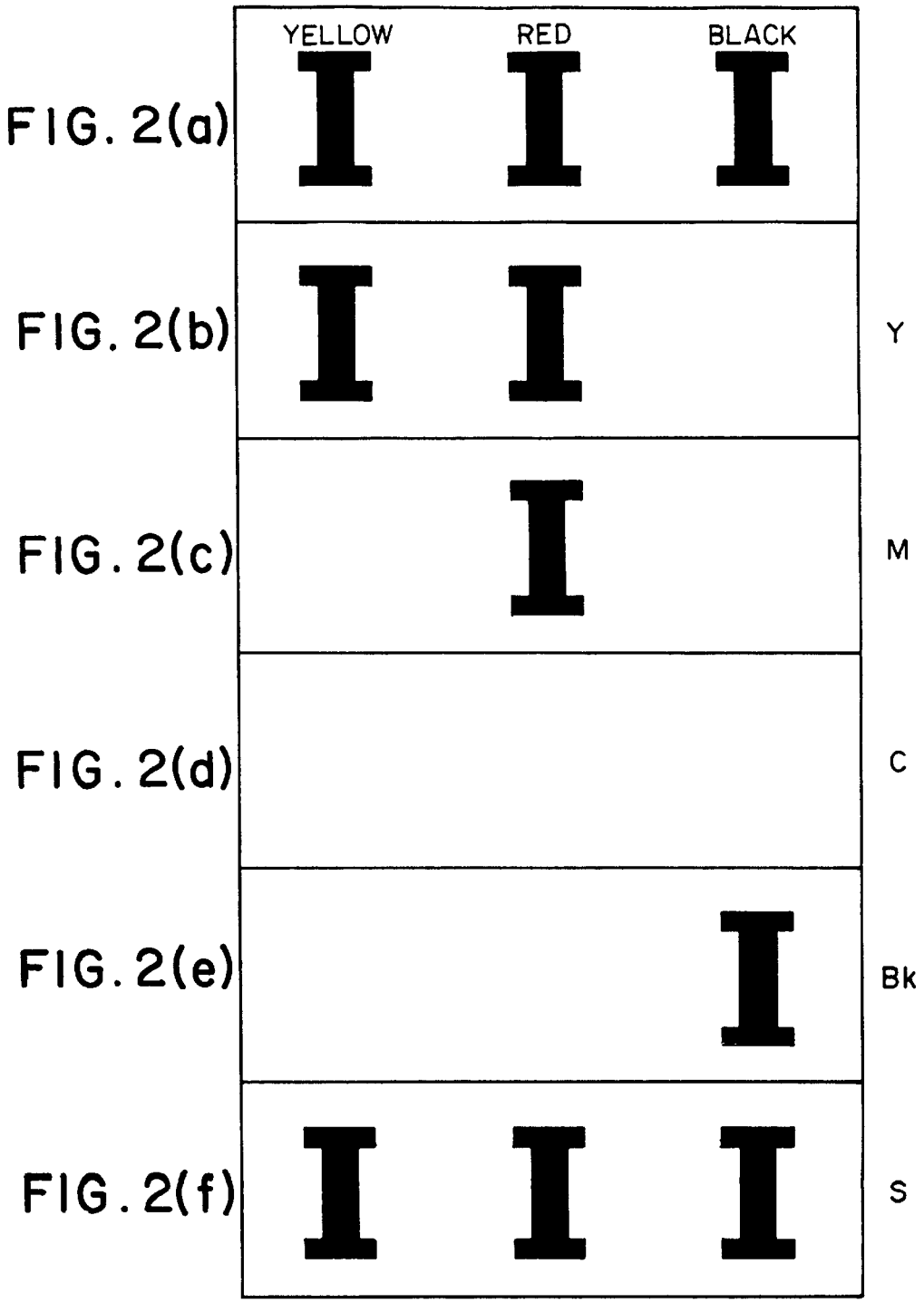
FIG. 2 is a table of S liquid data as a logic sum data D1 from the ink recording data for Y, M, C and Bk inks.

FIG. 2 gives examples of ejection point data D1 for ejecting the S liquid. They are formed on the basis of image data. In FIG. 2, an alphabetic reference (a) designates the image data to be recorded In this case, data for recording three characters "I" each of which is recorded in one of yellow, red and black colors, are presented. Each "I" comprises 8 (horizontal dots)×14 (vertical dots) picture elements. The ejection point data to be recorded are divided according to Y, M, C and Bk, wherein (b) represents the ejection point data for yellow Y; (c), magenta M; (d), cyan C; and (e) represents the ejection point data for black Bk. In order to record an image composed of the above three colors, the cyan C ink is not necessary; therefore. there is not an ejection point data for cyan C. A reference character (f) designates the ejection point data D1 for ejecting the S liquid. The data D1 is the logic sum of the ejection point data for the colors Y, M, C and Bk.

Figure 3:
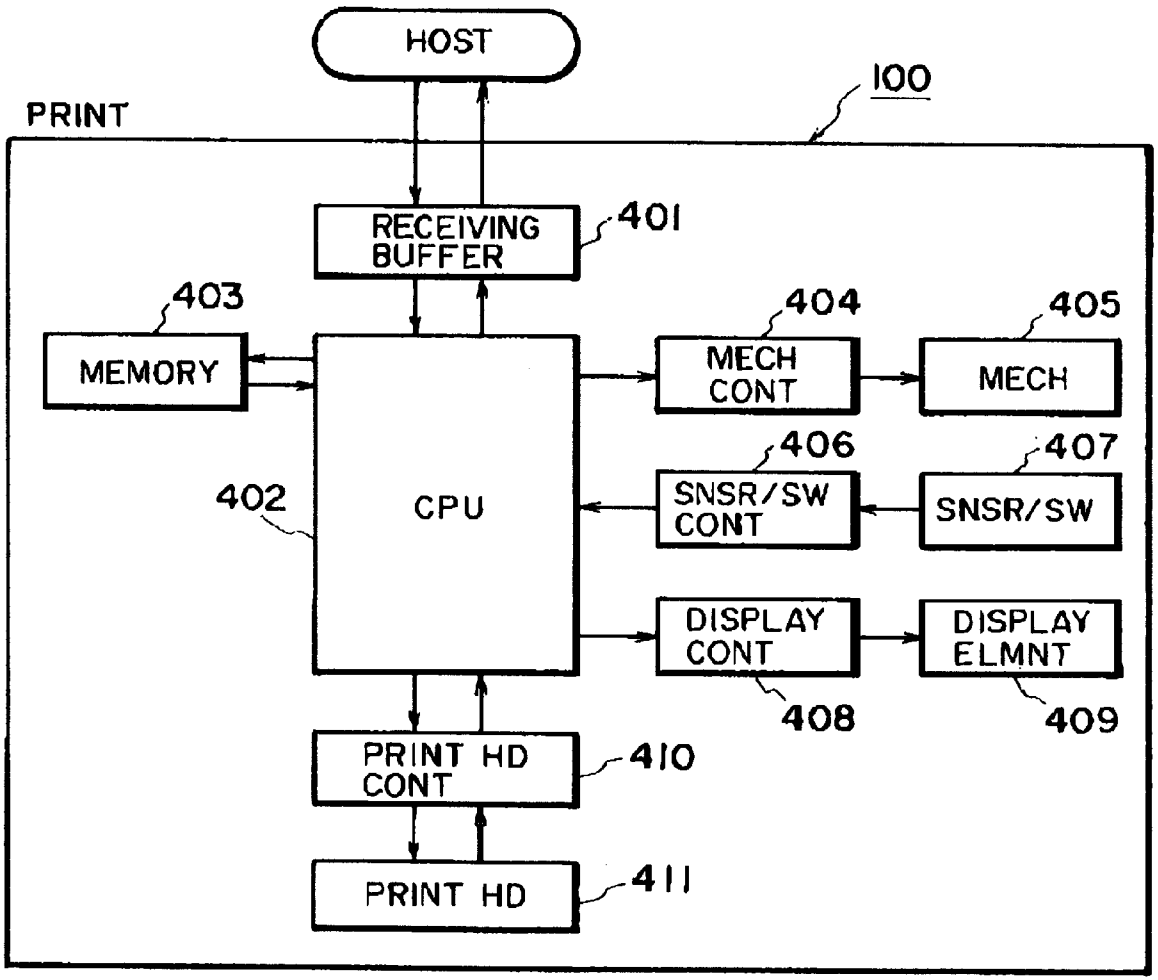
FIG. 3 is a block diagram of an ink jet printing apparatus to which the present invention is applicable.

FIG. 3 is a block diagram for an ink jet printing apparatus to which the present invention is applicable. Data for the characters or images to be printed (hereinafter, image data) are input from a host computer to a reception buffer 401 of the printing apparatus The data for confirming whether or not the data are accurately transmitted, and the data for notifying the operational condition of the printing apparatus, are sent back from the printing apparatus to the host computer. The data within the reception buffer 401 are transferred, under the control of a CPU 402, to a memory section 403, where they are temporarily stored in an RAM. A mechanical control section 404 drives the mechanical sections comprising a carriage motor, a line feed motor, and the like, in response to commands from the CPU 402. A sensor/SW control section 406 sends the signals from a sensor/SW section 407 comprising various sensors and switches, to the CPU 402. A display element control section 408 controls a display element section comprising display panel groups of LEDs or the like, in response to the commands from the CPU 402. A print head control section 410 controls a print head 411 in response to the commands from the CPU 406. The temperature data or the like, which indicate the conditions of the print head 411 are sensed and sent to the CPU 402.

Figure 4:
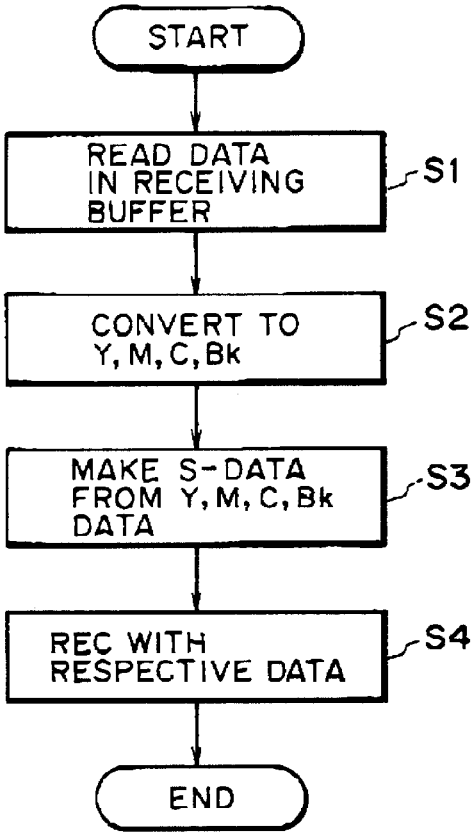
FIG. 4 shows flow of record data.

FIG. 4 is a diagram showing the flow of the data, on which the recording operation carried out by the aforementioned CPU 402 is based First, the recording data (ejection point data) is read into the reception buffer of the recording apparatus (step S1). Next, the recording data is developed into individual data for Y, M, C and Bk (step S2). Then, the recording data or the S liquid is derived from the logic sum of the Y, M, C and Bk data (step S3). Next, the S liquid is ejected from the correspondent recording head on the basis of the derived S liquid recording data, and thereafter, each of the Y, M, C and Bk inks is ejected from the correspondent recording head on the basis of the individual recording data of its own (step S4).

Thus, in the case of this method in accordance with the present invention, only a single liquid ejecting head is required since the S liquid is ejected on the basis of the recording data D1 derived from the logic sum of the individual recording data for Y, M, C and Bk; whereas in the conventional method, an S liquid for Y and a head for ejecting this S liquid, an S liquid for M and a head for ejecting this S liquid, an S liquid for C and a head for ejecting this S liquid, and an S liquid for Bk and a head for ejecting this S liquid, in other words, four S inks and four ejection heads therefor are necessary.

Further, according to the prior art, the S liquid is ejected over the entire area of the recording region of the recording medium. In other words, the S liquid is elected over the area with no correspondence to the recording data for the image producing ink. However, in this embodiment, the S liquid is ejected onto only the area correspondent to the recording data or recording with the image producing ink; therefore, the S liquid can be used efficiently.

Thus, this embodiment enjoys the merits of reducing the S liquid consumption, which in turn reduces the amount of the ink ejected per unit area of the recording medium.. Therefore, the wrinkling and/or cockling of the recording medium is reduced. Further, the landing point deviation of the ink droplet caused by this wrinkling and/or cockling is reduced. Consequently the recording quality is improved.

Figure 5:
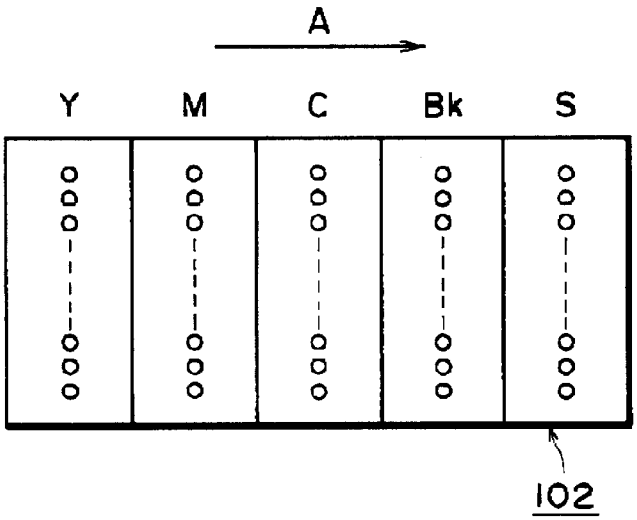
FIG. 5 is a front view of a recording head.

FIG. 5 is a front view of a recording head which is used to carry out the ink jet recording method in accordance with the present invention. This recording head is structured to eject five different inks. Each color is given 128 ejection orifices. The distance between the adjacent two arrays of the ejection orifices is ½ inch, and the distance between the adjacent two orifices among the 128 orifices assigned to each color is approximately 70 $\mu$m .

Each ink ejection orifice is provided with an ink liquid passage leading to the ejection orifices, and a common liquid chamber for supplying the ink into this ink liquid passage is disposed in the area behind the area where the ink liquid passage is disposed. In each of the ink liquid passage leading to the correspondent ejection orifice, an electrothermal transducer for generating thermal energy to be used for ejection of the ink droplet from the ejection orifice, is disposed along with electrode wiring for supplying electric power to this electrothermal transducer. The electrothermal transducer and electrode wiring are formed on a piece of substrate composed of silicon or the like using the film deposition technology. Further, partitioning walls, top plate, and the like composed of resin or glass material are laminated on this substrate to construct the aforementioned ejection orifices, ink liquid passages, and common liquid chamber.

From each of the ejection orifices provided in the recording head 102 for Y, M, C and Bk inks, an approximately 40 ng of the ink is ejected, whereas from the ejection orifice for the S liquid, approximately 30–40 ng of the special ink is ejected.

In the case of the recording head in this embodiment, the electrothermal transducer is employed to eject the ink, but the present invention is not limited by this embodiment. For example, a piezoelectric element may be employed In other words, the present invention is applicable to any ink ejecting means capable of recording images by ejecting the ink.

Next, a specific example in which the images are recorded using the above-described method will be described.

Firstly, the ink used in this example has the following composition, wherein the Y, M. C and Bk inks are composed of:

| | |
|---|---|
| Glycerin | 5 parts by weight |
| Thiodiglycol | 5 " |
| Urea | 5 " |
| Isopropylalcohol | 4 " |
| Dye | 3 " |
| Water | 78 " |

wherein, the dye is selected in correspondence with Y, M, C and Bk colors

Further, the S liquid has the following composition.

Embodiment 1

| | |
|---|---|
| Polyallylamine hydrochloride | 1.0 % by weight |
| Benzalconium chloride | 1.0 " |
| Thiodiglycol | 10.0 " |
| Acetylenol EH | 0.5 " |
| Water | 87.5 " |

After the recording is effected using S liquid of this composition, Y, M, C, Bk inks are shot. It has been confirm that good recording is effected on plain paper with high water-resistant property.

In the foregoing embodiment, S liquid Is shot on the basis of the data of logical sum of each of the recording data for Y. M, C and Bk. Since the S liquid contains Acetylenol EH (trade name, available from Kawaken Chemical, Japan), for example, which is a surfactant, the substantial water-resistant property can be provided even if the S liquid is not shot for all of the logical sum of the record data for Y, M, C and Bk. For example, the S liquid may be shot on the basis of thinned or skipped data D2 which is provided by skipping the logical sum data for Y. M, C, Bk on the basis of a predetermined pattern, fur example, staggered or checker pattern.

Figures 6A, 6B, 6C, 6D, 6E, 6F:
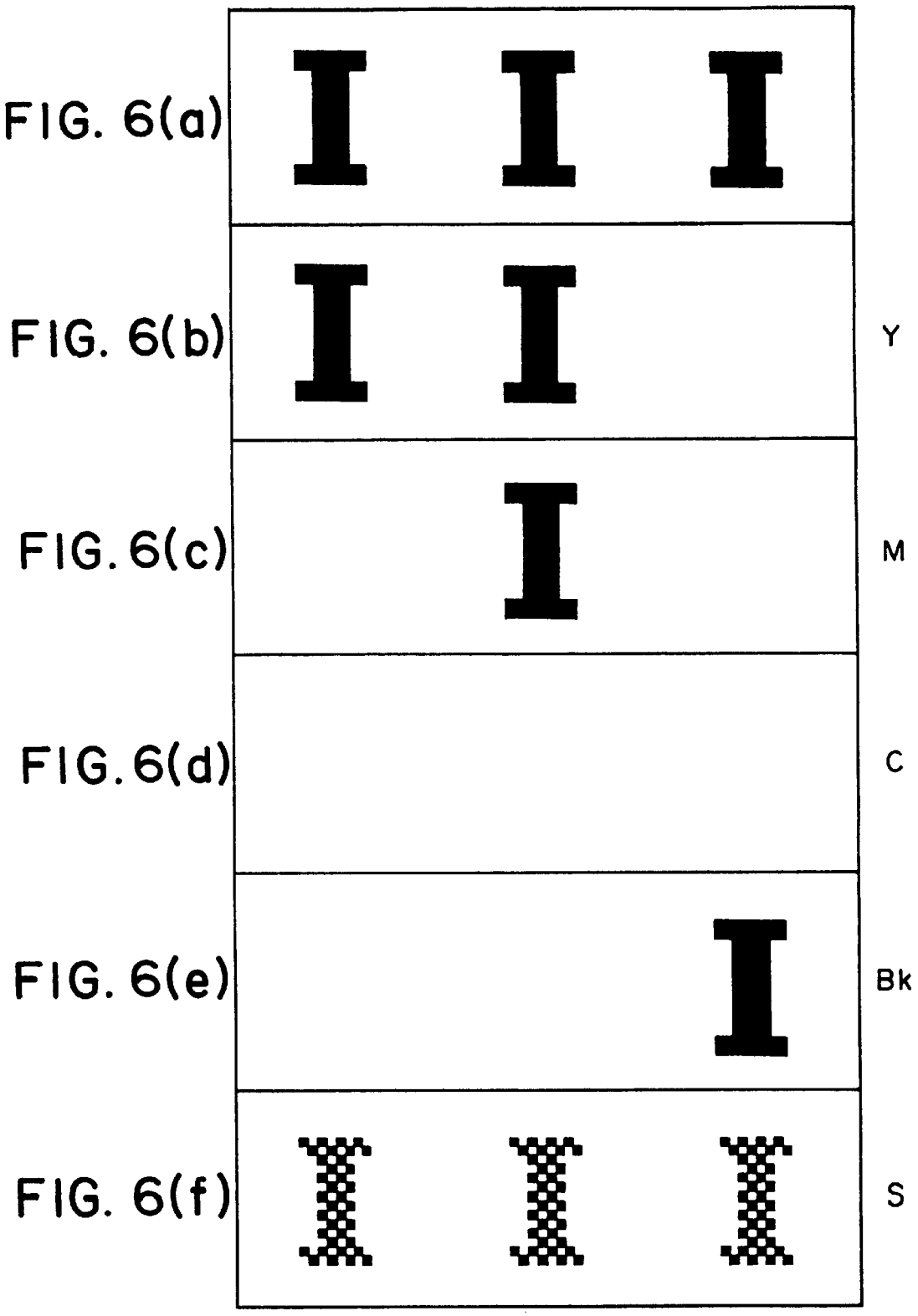
FIG. 6 shows an example of the S liquid data as data D2 provided by staggeredly thinning the logic sum of Y, M, C, Bk data.

FIG. 6 schematically shows the record data for the inks and the record improving liquid. As for the S-liquid data, the data D 2 provided by staggeredly thinning the logical sum data for Y, M, C and Bk, as shown in (f) in this Figure. In FIG. 5, (a) is the record data of an image to be printed, (b) is the record data for Y, (c) is the record data for M, (d) is the record data for C, and (e) is the record data for Bk. In FIG. 5, (f), the black portion indicates an area to which S liquid is to be ejected, and the white portion indicates the area to which the S liquid is not ejected.

If the recording is effected in this manner, the amount of the ink to be ejected per unit area of the recording material can be reduced, and therefore wrinkling, cockling or another unsmoothness of the recording material can be further reduced, so that the deviation of the shot position due to the unsmoothness can be diminished. The thinning is not limited to that providing an average one half duty. For example, using such S liquid that the dot diameter increases after the shot on the recording material, the thinning may be to one third of the logical sum data on the average.

Embodiment 2

Due to the manufacturing tolerance of the ink ejection outlet of the recording head of the recording apparatus, the shot position may be slightly deviated on the recording material. Therefore, if the S liquid is shot to the same position as the record data, the S liquid may be out of alignment with Y, M, C or Bk ink shot position. The problem can be avoided by using as S liquid record data the data D 3 which is provided by expanding the Y, M, C, Bk logical sum data outwardly around the data by one dot.

Figures 7A, 7B, 7C, 7D, 7E, 7F:
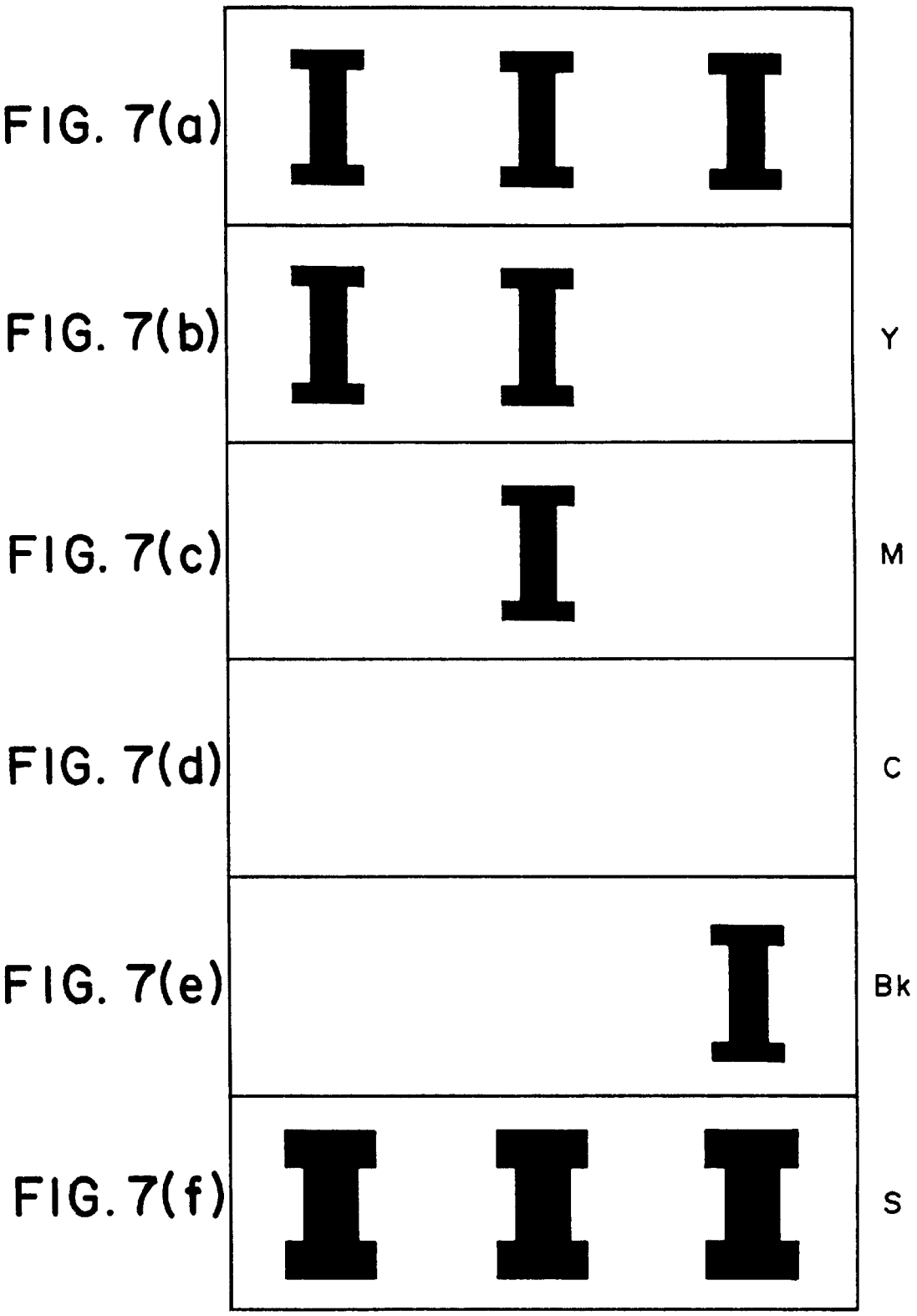
FIG. 7 shows an example of S liquid data as data D3 provided by circumferentially expanding, by one dot, the data of logic sum of Y, M, C, Bk data.

FIG. 7, (f) shows an example of the record data for the S liquid (data D3) thus provided. The data processing is such that the logical sum of the data which are provided by shifting in the upward, downward, leftward and rightward directions the logical sum data for Y, M, C, Sk and the logical sum data for Y. M, C, Bk.

In this example, the expansion corresponds to one dot around the data, but in some cases the expansion may corresponds to 3 dots depending on the positional deviation of the shot position.

When the use is made with data D4 which are provided by staggered thinning the data D3, the consumption of the record improving liquid can be reduced substantially without deteriorating the water-resistant property.

Figures 8A, 8B, 8C, 8D, 8E, 8F:
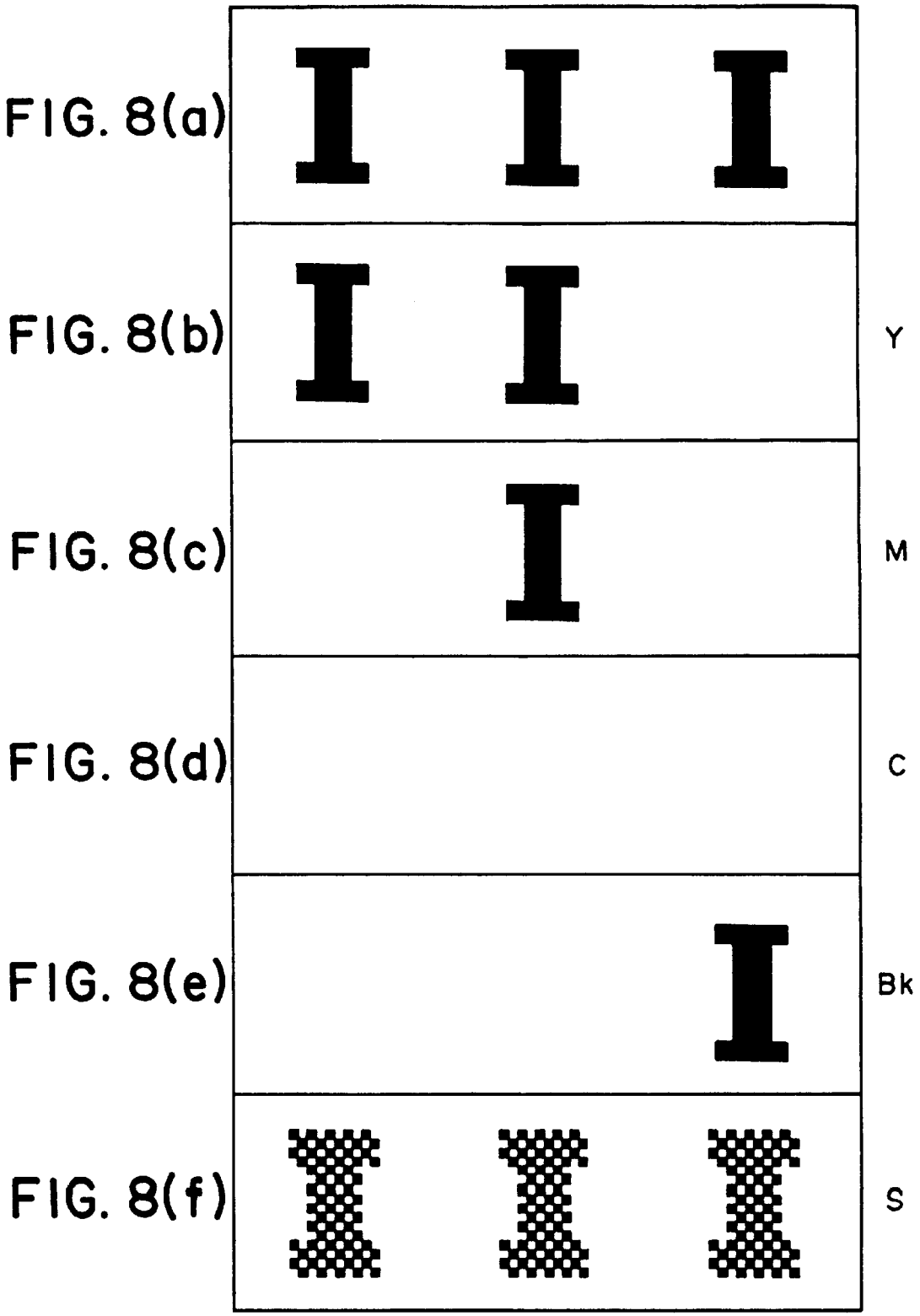
FIG. 8 shows an example of S liquid data as data D4 provided by staggeredly thinning the data provided by circumferentially expanding, by one dot, the data of logical sum of Y, M, C, Bk data.

FIG. 8, (f) shows an example of data D4 which are provided by staggeredly thinning the data D3.

Embodiment 3

In the foregoing embodiment, the logical sum data for Y, M, C, Bk are used for the record data for the S liquid. The read (R), green (G), blue (B) colors which are the secondary colors are expressed by recording twice the amount of Y, M, C, Bk which are the primary colors. Therefore, if amount of the S liquid for R, G, B is larger than that for Y. M, C, Bk, the chemical reaction between the S liquid and Y. M, C or Bk Ink is uniform. In other words, the ejection duty for the S liquid for the primary color recording is made smaller than the ejection duty for the S liquid for the secondary color recording. In other words, the amount of ink ejection per unit area for the S liquid for the secondary color recording is preferably larger than the amount of ejection per unit area for the S liquid for the primary color recording.

This is accomplished in the following manner. The S liquid for R, G, B is determined on the basis of the logical sum for R, G, B data, whereas the S liquid for Y, M, C, Bk is determined as the data provided by staggeredly thinning the logical sum of Y, M, C, Bk data.

Figure 9:
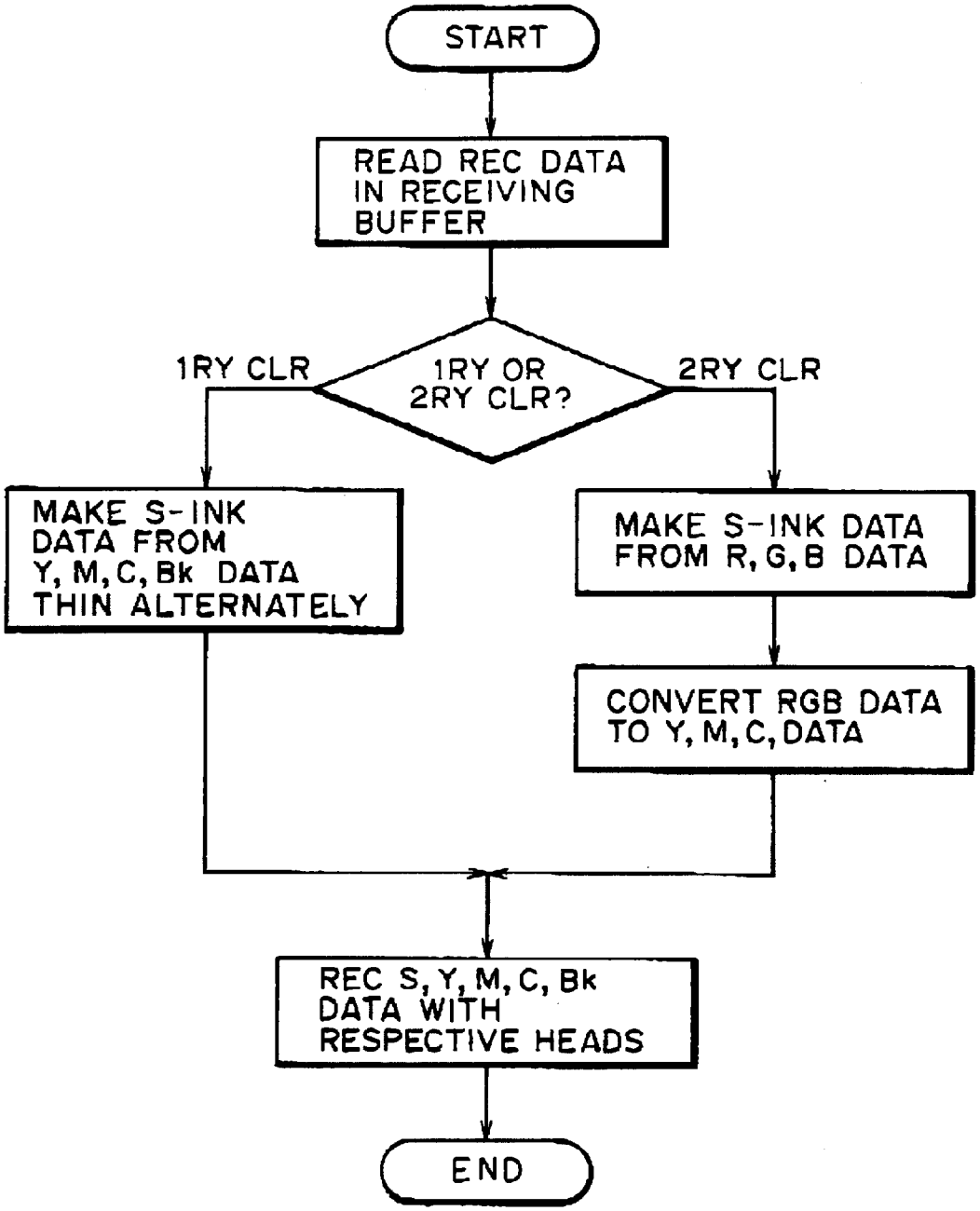
FIG. 9 is a flow chart of a process for obtaining S liquid data for primary color and secondary color, respectively.
Figure 10A:
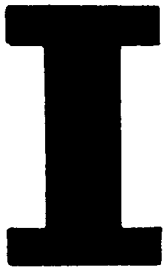
FIG. 10 shows an example of S liquid ejection data when only black ink is used.
Figure 10B:
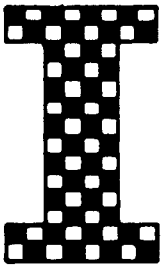
Figure 10C:
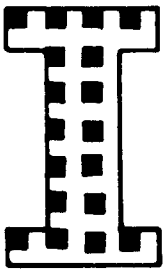
Figure 10D:
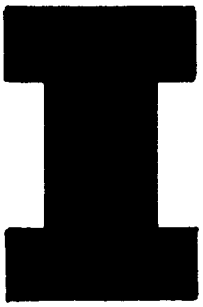
Figure 10E:
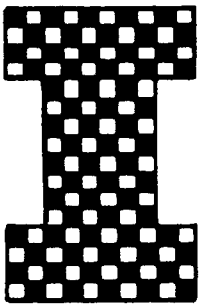
Figure 10F:
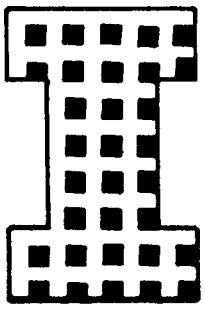

FIG. 9 is a flow chart for obtaining data for the S liquid for the primary color and the secondary color, respectively. The primary color is Y, M, C or Bk color, and the secondary color is R. G or B color.

Thus, the uniform water-resistant property can be provided by making the amount of the S liquid for the secondary color than that for the primary color.

Embodiment 4

FIG. 10 illustrates an example of producing the ejection data for the S liquid when only black (Bk) ink is used.

(a) indicates image data D21 to be recorded with black ink. Here, a character "I" is recorded as an example. The character "I" is constituted by 8 dot×14 dot (horizontal×vertical). Here, the dot means a point of minimum pixel to be recorded by one ink droplet. The following (b), (c). (e) and (f) are examples of the ejection data for the S liquid in this embodiment.

(b) indicates data D22 provided by thinning one dot from two dots in the vertical and horizontal directions, the data D21. Here, the staggered thinning is used.

(c) indicates data D23 provided by removing one dot from four dots of the data D21 in the vertical and horizontal directions.

(d) indicates data D24 provided by expanding the data D21 by one dot at the peripheries. The data D24 are provided as a logical sum of the data D21 and the data provided by shifting the data D21 by one bit upwardly, downwardly, leftwardly and rightwardly.

(e) indicates data D25 which are provided by removing one dot from two dots of the data 24 in the vertical and horizontal directions.

(f) indicates data D26 provided by removing one dot from four dots of the data 24 in the vertical and horizontal directions.

By using the data (b) as the S liquid data, the water resistant property and the record density can be increased with the S liquid of one half the duty of that of the ink data, by the reaction between the ink and the S liquid.

By using the data (c) as the S liquid data, the water resistant property and the record density can be improved with the S liquid of one fourth of the duty of the ink data by the reaction between the ink and the S liquid.

The data (e) and (f) are used as the S liquid data in order to prevent the feathering at the edges of the record data or in order to increase the sharpness at the edge. Additionally, it is also effective when the S liquid is shot at a position slightly deviated due to the property of the recording head.

By using the data (e) as the S liquid data, the water resistant property and the record density improvement can be provided by the S liquid with one half the duty of the ink data duty, as compared with the data (d) is used as the S liquid data.

By using the data (f) as the S liquid data, the water resistant property and the improvement of the record density can be provided with the S liquid of the duty one fourth of the ink data duty, as compared with the S liquid data (d).

Here, the data 25 and the data 26 are provided by expanding by one dot, but day may be provided by expending by 2 dots or 3 dots or more depending on the shooting property of the S liquid or the ink, or the property of the ink or the S liquid itself.

The printed product provided in the foregoing embodiment, the image area provided by the ink of the printed product in the foregoing embodiment is constituted by an area having both of the color ink and the S liquid, and an area having only the color ink without the S liquid, and the sufficient water resistant property and high image quality can be provided.

In the foregoing embodiments, the recording material has been described as plain paper, but it may be, paper, cloth, unwoven textile, ORP sheet. The apparatus may be a printer, a copying machine, a facsimile machine or the like.

In this embodiment, the application of the ink onto the recording material may be before or after the application of the record improving liquid.

In the foregoing embodiments, the Y, M, C and Bk inks are of dye materials, and the recording material improving liquid functions to make the coloring component in the ink insoluble or coagulate the coloring material. The coloring material may be pigments.

In the foregoing embodiments, four color inks are used, or only Bk ink is used. However, the present invention is applicable to the case of use of three color inks, namely, Y, M, C inks. Further alternatively, read and black inks (two color inks) are usable.

Further alternatively only one color ink (read, for example) is usable. Furthermore, dark and light black ink are usable.

Other examples of the record properly increasing liquid for making the ink dye insoluble or coagulating it, will be described.

The following materials are mixed and dissolved, and the mixture is pressed and filtered through a membrane filter (Fluoropore Filter, available from Shumitomo Denko Kabushiki Kaisha, Japan) having a pore size of 0.22 $\mu$m. Then, pH thereof is adjusted to 4.8 by NaOH, thus producing print quality improving liquid Al.

[Al]

| | |
|---|---|
| Stearyl trimethylammonium chloride (trade name: Electrostopper QE, available from Kao Kabushiki Kaisha, Japan) | 2.0 parts |
| High-molecular component of cation compound Polyamine sulfone (average molecular weight: 5000) (trade name: PAS-92, available from Nittobo Kabushiki Kaisha, Japan) | 3.0 parts |
| Thiodiglycol | 10 parts |
| Water | rest |

As the ink becomes insoluble by mixing with the print quality improving liquid described above, the following is usable.

The following materials are mixed, and the mixture is pressed and filtered through a membrane filter (trade name: Chloropore Filter, available from Shumitomo Denko Kabushiki Kaisha) having a pore size of 0.22 $\mu$m, thus producing yellow, magenta, cyan and black inks Y 1, Ml, Cl and Bkl.

[YI]

| | |
|---|---|
| C. I. Direct Yellow 142 | 2 parts |
| Thiodiglycol | 10 parts |
| Acetylenol ED (available from Kawaken Fine Chemical Kabushiki Kaisha, Japan) | 0.05 part |
| Water | rest |

[M}

The same materials as Y1 except that the dye material is replaced with C.I. Acid Red 289 (2.5 parts).

[C1]

The same materials as Y1 except that the dye material is replaced with C.I. Acid Blue 9 (2.5 parts).

[Bkl]

The same as Y1 except that the dye material is replaced with C.I. Food Black 2 (3 parts).

When the print quality improving liquid (liquid material) and the ink, the mixture occurs on or in the recording or printing material. Therefore, at the first stage of the reaction, the low molecular weight component or cation oligomer of the cation material in the print quality improving liquid, and the anion compound in the pigment ink or the water soluble dye having the anion group in the ink, meet by ion reaction with the result of instantaneous separation from the solvent. Thus, in the case of the pigment ink, the dispersion is destroyed to produce coagulation of the pigment.

At the second stage of the reaction, the product of the meeting of the dye and the cation oligomer or the low molecular cation material or the coagulation of the pigment is absorbed by the high molecule component contained in the print quality improving liquid, so that the coagulation of the dye and the coagulation of the pigment is increased in the size. Therefore, it does not easily enter the clearances between fibers of the printing material. Accordingly, only the liquid part of the solid-liquid separated material seeps into the printing material. Thus, the print quality and the fixing property are both improved. Additionally, the viscosity of the coagulation of the pigment or the coagulation formed by the cation material and the anion dye and the cation oligomer or the low-molecular component of the cation material, increases, so that the coagulation does not move with the solvent. For this reason, even if adjacent ink dots are of different color inks as in the case of full-color image formation, the color mixture does not occur, and bleeding does not occur. The coagulation is essentially non-water-soluble, and therefore, the water-resistant property is improved. Furthermore, the blocking effect of the polymer material is effective to improve light resistance.

In this invention, in an example of the coagulation or the insolubility is provided in the above-described first stage, and in another example, it is provided in the first and second stages.

In the present invention, there is no need of using high molecular weight cation material or polyvalent metal salt, or if any, it is only used as an auxiliary component to first improve the effect, and therefore, the amount thereof can be minimized. As a result, the deterioration of the coloring of the dye which has been the problem when the water-resistant property is obtained using the cation high molecule material or the polyvalent metal salt, can be avoided as a particular effect of the present invention.

The printing material usable with the present invention is not particularly limited, and the usable materials include copy paper, bond paper or another plain paper, or OHP transparent film or coated paper particularly prepared for the ink jet printing. Usual high quality paper or glossing paper can be preferably usable.

The present invention is particularly suitably usable in an ink jet recording headland recording apparatus wherein thermal energy by an electrothermal transducer, laser beam or the like is used to cause a change of state of the ink to eject or discharge the ink This is because the high density of the picture elements and the high resolution of the recording are possible.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fixed on the main assembly to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, an additional heating element or a combination thereof. Also, means for affecting preliminary ejection (not for the recording operation) can stabilize the recording operation.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving functions.

Figure 11:
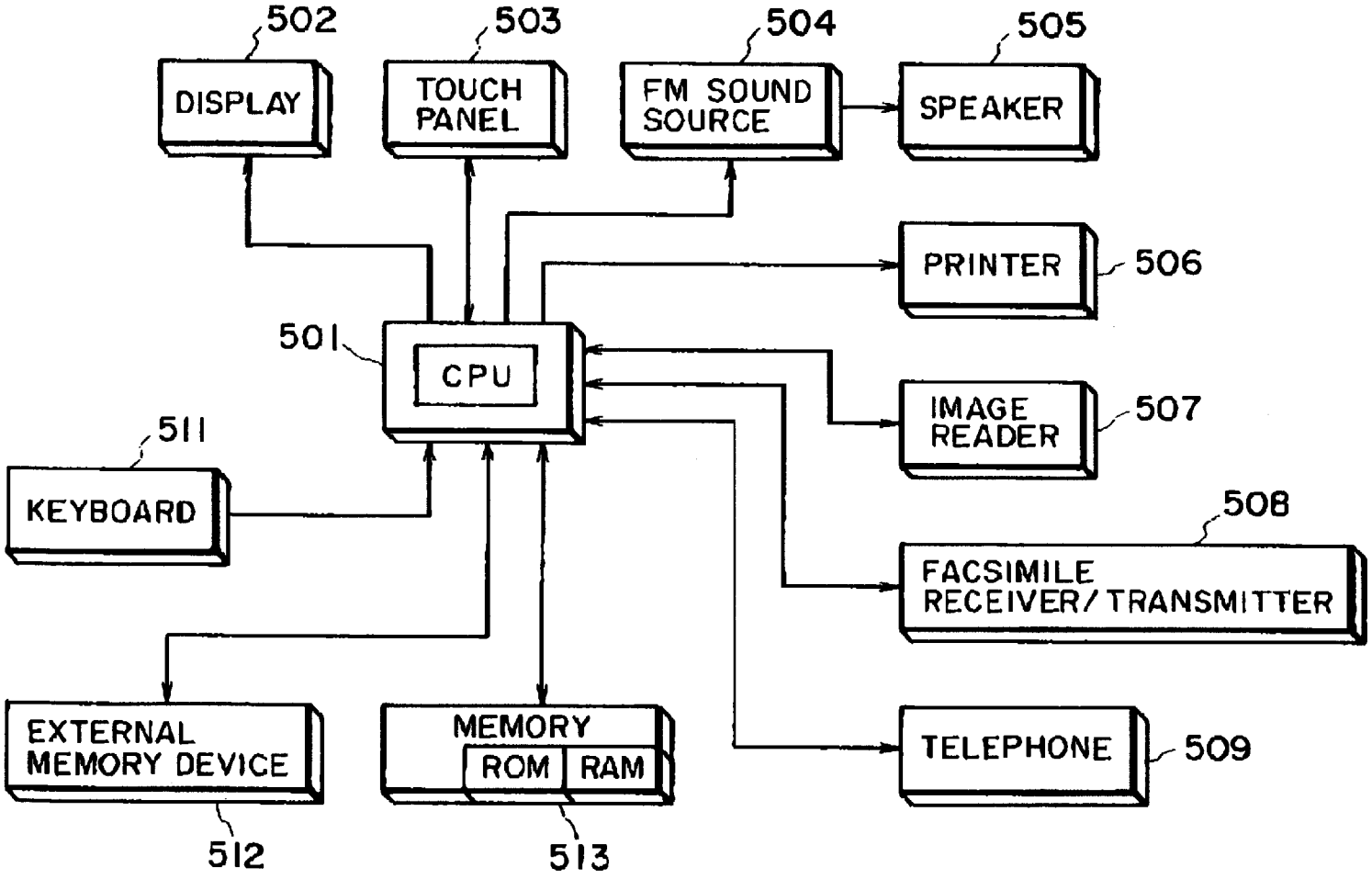
FIG. 11 is a block diagram when the recording apparatus according to the present invention to an information processing apparatus.

FIG. 11 is a block diagram of an information processing apparatus having a function of wordprocessor, personal computer, facsimile machine, copying machine, electronic typewriter or the like, as a recording apparatus of this invention. Reference numeral 501 designates a controller for controlling the entire apparatus, and is provided with CPU in the form of a microprocessor or the like or various I/O ports. It functions to supply control signals and data signals or the like to various parts and to receive control signals and the data signals from various parts. Reference numeral 502 designates a display for displaying various menus, document information, image data read by an image reader 507, or the like. A pressure sensitive type touch panel 503 is provided on the display 502. By depressing the surface thereof by the finger or the like, the items or the coordinate position can be selected and inputted on the display 502.

An FM (Frequency Modulation) sound source 504 stores music information produced by music editor or the like in memory 513 or external memory 512 has digital data, and functions to read the information out of the memory or the like to effect the FM modulation. The electric signal from the FM sound source 504 is converted to audible sound by a speaker 505. A printer station 506 functions as an output terminal of a word processor, personal computer, facsimile machine, copying machine, electronic typewriter or the like, and is constituted in accordance with the present invention.

An image reader 507 for photoelectrically reading the original or document data and supply it to the outside is provided in the document feeding path, and functions to read various originals such as facsimile original or copy original. A facsimile sender and receiver 508 functions to to send the document data read by the image reader 507 and to receive the sent facsimile signal and to decode them, and has a function of interface with the outside. A telephone section 509 has a function of normal telephone function and other various functions such as message recording function upon absence.

Memory 513 includes ROM for storing system program, managing program, application program or the like, character font, directionally and the like, and memory for storing application program loaded the external memory 512 or the video RAM or the like.

Designated by reference numeral 511 is a keyboard for inputting document information, various command or the like; 512 is external memory using recording medium such as floppy disk, hard disk or the like. The external memory 512 stores character information, music information or voice information, or application program of the user or the like.

Figure 12:
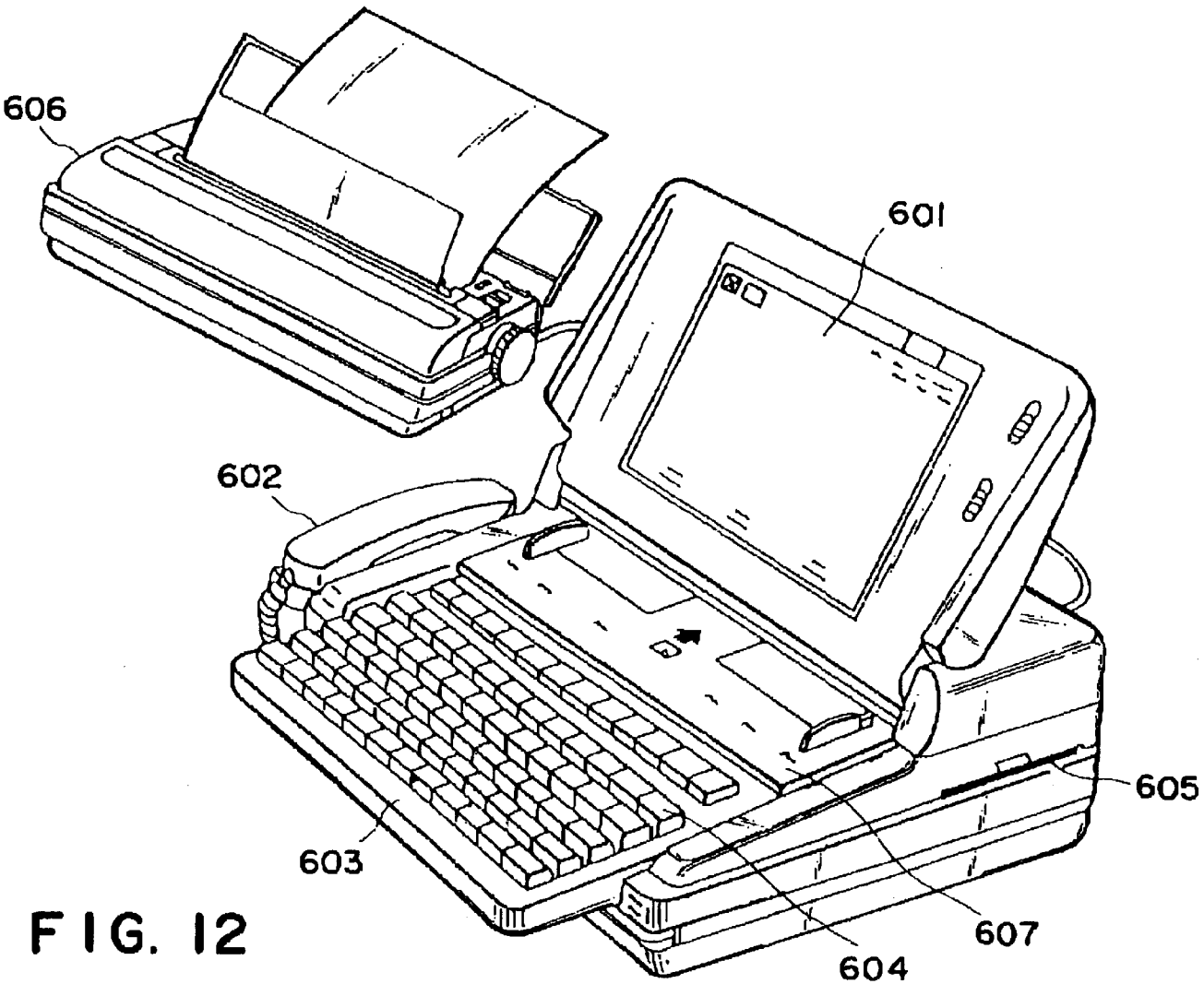
FIG. 12 shows an outer appearance of the information processing apparatus of FIG. 9.

FIG. 12 shows an outer appearance of information processing apparatus of FIG. 11. A flat panel display 601 of liquid crystal type or the like functions to display various menus, graphic information or document information. The display 601 is provided with a touch panel. By depressing the surface of the touch panel by the finger or the like, the item or coordinate position can be selected and inputted. Designated by 602 is a hand set to be used as a telephone set.

The keyboard 603 is detachably connected with the main assembly by a cable, and permits various character information or data input. The keyboard 603 is provided with various function keys 604 or the like. Designated by 605 is an entrance for a floppy disk.

The original or document to be read by the image reader 507 is placed on an original supporting platen 607, and the document having been read is discharged at the rear part of the apparatus. In the case of the facsimile information reception, the information is printed by a printer 606.

The display 601 may be CRT, but it is preferably a flat panel using liquid crystal display such as ferroelectric, since then, the size, thickness and weight can be reduced. When the information processing apparatus is used a personal computer or wordprocessor, the various information inputted by the keyboard 511 in FIG. 11 is processed by the controller 501 through predetermined programs, and the information is outputted as an image by the printer section 506. When it functions as a receiver of a facsimile function, the facsimile information supplied by the facsimile machine section 508 through the communication line is received and processed by the controller 501 through predetermined programs, and is outputted as a received image by the printer section 506.

Figure 13:
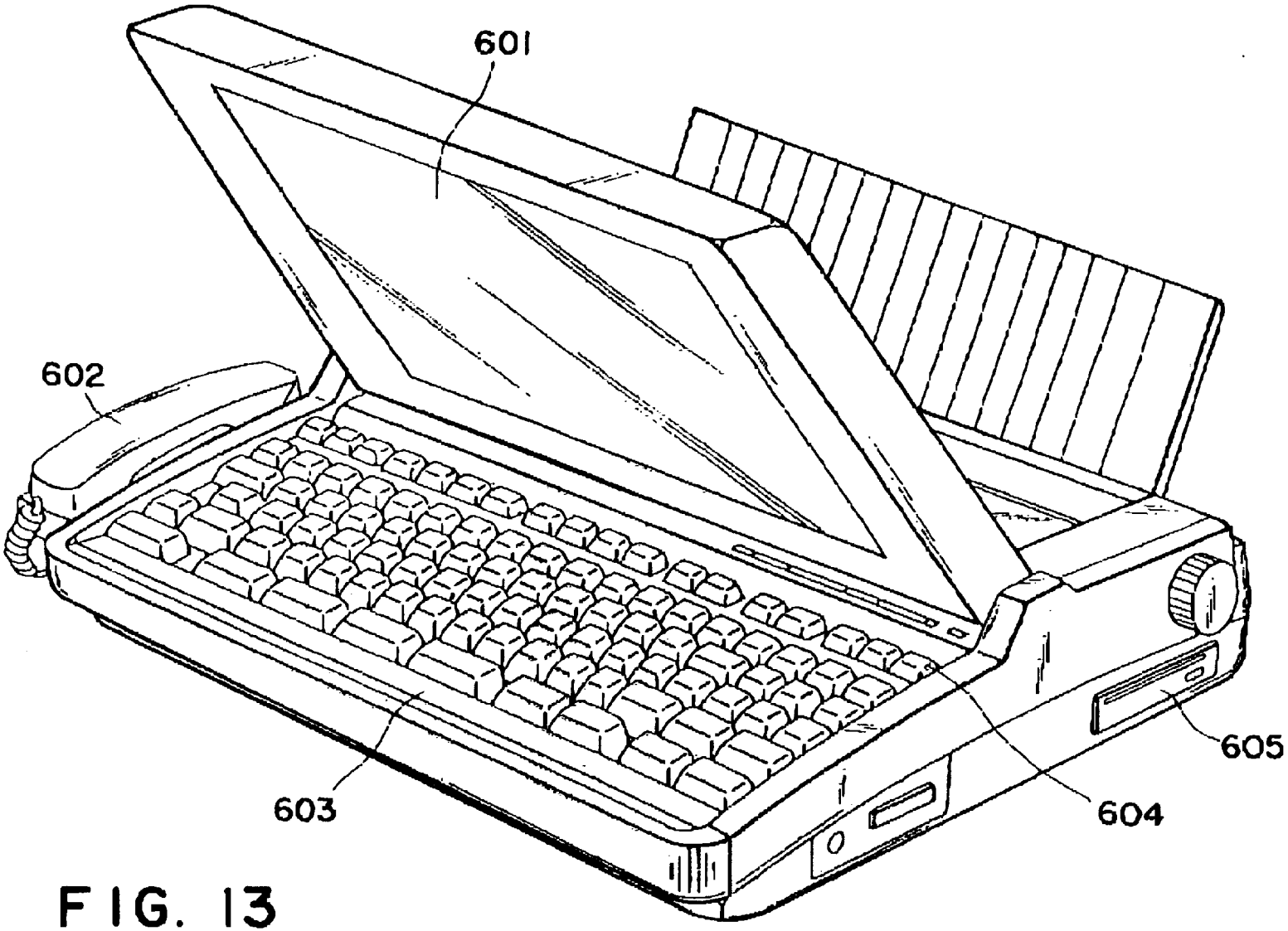
FIG. 13 shows an outer appearance of the image processing apparatus having integral printer according to the present invention.

When it functions as a copying machine, the original is read by the image reader 507, and the original document data thus read is outputted as a copy image by the printer section 506 through the controller 501. When it functions as a sender of the facsimile function, the document data read by the image reader 507 is sent out through predetermined programs by the a controller 501, and then are sent out to the communication line through the facsimile sender and receiver 508. The information processing apparatus may be an integral type having a built-in printer, as shown in FIG. 13 In this case, the apparatus is easily transported. In this Figure, the same reference numerals as in FIG. 12 are assigned to the elements having the corresponding functions.

By applying the recording apparatus of this invention to the above-described multi-function image processing apparatus, the high quality print can be provided, thus improving the functions of the information processing apparatus.

While the invention has been described with reference to the structures disclosed herein, it is not confined to the details set forth and this application is intended to cover such modifications or changes as may come within the purposes of the improvements or the scope of the following claims.

What is claimed is:

1. A recording method by ejecting ink droplets and liquid droplets for rendering insoluble or coagulating coloring material or a component in the ejected ink on a recording material, comprising the steps of:

obtaining image data to be printed by ink droplets;

obtaining liquid ejection data by thinning image data;

ejecting ink onto the recording material on the basis of the image data; and ejecting the liquid onto the recording material on the basis of the liquid ejection data such that the liquid and the ink overlap partially each other, wherein one of said ink ejecting step and said liquid ejecting step are carried out after the other;

wherein at the time when both said ink ejecting step and said liquid ejecting step are carried out, the number of the ejected ink dots on the recording material by said ink ejecting step is larger than the number of the ejected liquid dots on the recording material by said liquid ejecting step to provide, on the recording material, both a first portion where the liquid and the ink overlap each other and a second portion where the ink is ejected and the liquid and the ink do not overlap each other, where in the liquid droplet spreads after landing on the recording material to come in contact with the ink in the second portion where the liquid and the ink do not overlap each other.

2. A method according to claim 1, wherein in said liquid ejecting step, the liquid is ejected in accordance with a pattern provided by thinning the ink-ejection-area with a predetermined pattern.

3. A method according to claim 1, wherein in said liquid ejecting step, the liquid is ejected in accordance with a pattern provided by expanding the ink-ejection-area.

4. A method according to claim 3, wherein a degree of the expansion corresponds to a predetermined number of dots.

5. A method according to claim 1, wherein the ink includes a plurality of different color inks, and positions of the liquid ejection are determined in accordance with a logical sum of image data for ejecting the inks.

6. A method according to claim 5, wherein the positions are determined in accordance with data provided by thinning a logical sum of the image data in accordance with a predetermined pattern.

7. A method according to claim 5, wherein said plurality of the inks include yellow, magenta and cyan inks.

8. A method according to claim 5, wherein said plurality of the inks include yellow, magenta, cyan and black inks.

9. A method according to claim 8, wherein the positions are determined in accordance with data provided by thinning a logical sum of the image data for each ink in accordance with a predetermined pattern.

10. A method according to claim 8, wherein the positions are determined in accordance with a logical sum of the image data for each ink, and the liquid is ejected in accordance with a pattern provided by expanding the ink-ejection-area at periphery thereof by a predetermined number of dots.

11. A method according to claim 8, wherein the positions are determined in accordance with data provided by thinning a logical sum of the image data for each ink, and the liquid is ejected in accordance with a pattern provided by expanding the ink-ejection-area at periphery thereof by a predetermined number of dots.

12. A method according to claim 8, wherein an ejection duty of the liquid ejection for a primary color ink is smaller than an ejection duty of the liquid ejection for a secondary color.

13. A method according to claim 8, wherein an ejection amount, per unit area of the recording material, of the liquid for a primary color is smaller than that for a secondary color.

14. A method according to claim 1, wherein the liquid and ink are ejected by an ink jet head.

15. A method according to claim 14, wherein the ink jet head has an electrothermal transducer for ejecting the ink by thermal energy.

16. A recording apparatus for performing recording on a recording material by ejecting ink droplets and liquid droplets for rendering insoluble or coagulating coloring material or a component in the ejected ink on the recording material, comprising:

a first obtaining means for obtaining image data to be printed by ink droplets;

a second obtaining means for obtaining liquid ejection data by thinning out the image data obtained by the first obtaining means;

an ink ejection head for ejecting the ink onto the recording material on the basis of the image data obtained by the first obtaining means;

a liquid ejection head for ejecting the liquid onto a recording material on the basis of the liquid ejection data obtained by the second obtaining means such that the liquid and the ink overlap partially each other;

a first driving signal application means for applying a driving signal to said ink ejection head on the basis of the image data obtained by the first obtaining means; and a second driving signal application means for applying a driving signal to said liquid ejection head on the basis of the liquid ejection data obtained by the second obtaining means, wherein one of said ink ejection head and said liquid ejection head performs respectively ejection after the other;

wherein at the time when both said ink ejection head and said liquid ejection head perform ejection, the number of the ejected ink dots on the recording material by said ink ejection head is larger than the number of the ejected liquid dots on the recording material by said liquid ejection head to provide, on the recording material, both a first portion where the liquid and the ink overlap each other and a second portion where the ink is ejected and the liquid and the ink do not overlap each other, wherein the liquid droplet spreads after landing on the recording material to come in contact with the ink in the second portion where the liquid and the ink do not overlap each other.

17. A recording apparatus comprising:

a memory for receiving image data to be printed;

thinning means for thinning the received image data;

an ink ejection head for ejecting ink onto an ink-receiving area of a recording material in accordance with image data;

a liquid ejecting head for ejecting liquid for rendering insoluble or for coagulating coloring material or a component in the ejected ink onto a recording material;

ejecting position data determining means for determining positions of ejection of the liquid in accordance with image data for ejecting the ink to eject the liquid to a part of an ink-ejection-area on the recording material to provide liquid-ejection-area and non-liquid-ejection-area; and driving signal application means for applying a driving signal to said liquid ejecting head in accordance with the data determined by said determining means; and original image reading means for reading an original image to provide the image data to said ejection position data determining means, wherein one of said ink ejection head and said liquid ejection head performs respectively ejection after the other; said liquid ejection head ejects the liquid onto only a part of an ink-receiving-area of the recording material to render the area ink insoluble or to coagulate the area of ink on the recording material by ejecting droplets of the liquid on the basis of data provided by thinning data for ink ejection, wherein at the time when both said ink ejecting head and said liquid ejecting head perform ejection, the number of the ejected ink dots on the recording material by said ink ejecting head is larger than the number of the ejected liquid dots on the recording material by said liquid ejecting head to provide, on the recording material, both a first portion where the liquid and the ink overlap each other and a second portion where the ink is ejected and the liquid and the ink do not overlap each other, wherein the liquid droplet spreads after landing on the recording material to come in contact with the ink in the second portion where the liquid and the ink do not overlap each other.

18. A recording apparatus comprising:

a memory for receiving image data to be printed;

thinning means for thinning the received image data;

an ink ejection head for ejecting ink onto an ink-receiving area of a recording material in accordance with image data;

a liquid ejecting head for ejecting liquid for rendering insoluble or for coagulating coloring material or a component in the ejected ink onto a recording material;

ejecting position data determining means for determining positions of ejection of the liquid in accordance with image data for ejecting the ink to eject the liquid to a part of an ink-ejection-area on the recording material to provide liquid-ejection-area and non-liquid-ejection-area; and driving signal application means for applying a driving signal to said liquid ejecting head in accordance with the data determined by said determining means;

sending means for sending the image data; and receiving means for receiving the image data from said sending means, wherein one of said ink ejection he ad and said liquid ejection head performs respectively ejection after the other; said liquid ejection head ejects the liquid onto only a part of an ink-receiving-area of the recording material to render the area ink insoluble or to coagulate the area of ink on the recording material by ejecting droplets of the liquid on the basis of data provided by thinning data for ink ejection, wherein at the time when both said ink ejecting head said liquid ejecting head perform ejection, the number of the ejected ink dots on the recording material by said ink ejecting head is larger than the number of the ejected liquid dots on the recording material by said liquid ejecting had to provide, on the recording material, both a first portion where the liquid and the ink overlap each other and a second portion where the ink is ejected and the liquid and the ink do not overlap each other, wherein the liquid droplet spreads after landing on the recording material to come in contact with the ink in the second portion where the liquid and the ink do not overlap each other.

19. An apparatus according to claim 18, further comprising original image reading means for reading an original image and for supplying the image data to the sending means.

20. A recording apparatus comprising:

a memory for receiving image data to be printed;

thinning means for thinning the received image data;

an ink ejection head for ejecting ink onto an ink-receiving area of a recording material in accordance with image data;

a liquid ejecting head for ejecting liquid for rendering insoluble or for coagulating coloring material or a component in the ejected ink onto a recording material;

ejection position data determining means for determining positions of ejection of the liquid in accordance with image data for ejecting the ink to eject the liquid to a part of an ink-ejection-area on the recording material to provide liquid-ejection-area and non-liquid-ejection-area; and driving signal application means for applying a driving signal to said liquid ejecting head in accordance with the data determined by said determining means; and image data input means for inputting the image data and supplying it to the ejection position data determining means, herein one of said ink ejection head and said liquid ejection head performs respectively ejection after the other; said liquid ejection head ejects the liquid onto only a part of an ink-receiving-area of the recording material to render the area ink insoluble or to coagulate the area of ink on the recording material by ejecting droplets of the liquid on the basis of data provided by thinning data for ink ejection, wherein at the time when both said ink ejecting head and said liquid ejecting head perform ejection, the number of the ejected ink dots on the recording material by said ink ejecting head in larger than the number of the ejected liquid dots on the recording material by said liquid ejecting head to provide, on the recording material, both a first portion where the liquid and the ink overlap each other and a second portion where the ink is ejected and the liquid and the ink do not overlap each other, wherein the liquid droplet spreads after landing on the recording material to come in contact with the ink in the second portion where the liquid and the ink do not overlap each other.

21. A recording apparatus comprising:

a memory for receiving image data to be printed;

thinning means for thinning the received image data;

an ink ejection head for ejecting ink onto an ink-receiving area of a recording material in accordance with image data;

a liquid ejecting head for ejecting liquid for rendering insoluble or for coagulating coloring material or a component in the ejected ink onto a recording material;

ejecting position data determining means for determining positions of ejection of the liquid in accordance with image data for ejecting the ink to eject the liquid to a part of an ink-ejection-area on the recording material to provide liquid-ejection-area and non-liquid-ejection-area; and driving signal application means for applying a driving signal to said liquid ejecting head in accordance with the data determined by said determining means;

wherein one of said ink ejection head and said liquid ejection head performs respectively ejection after the other in sequence; said liquid ejection head ejects the liquid onto only a part of an ink-receiving-area of the recording material to render the area ink insoluble or to coagulate the area of ink on the recording material by ejecting droplets of the liquid on the basis of data provided by thinning data for ink ejection, wherein at the time when both said ink ejecting head and said liquid ejecting head perform ejection, the number of the ejected ink dots on the recording material by said ink ejecting head is larger than the number of the ejected liquid dots on the recording material by said liquid ejecting head to provide, on the recording material, both a first portion where the liquid and the ink overlap each other and a second portion where the ink is ejected and the liquid and the ink do not overlay each other, wherein the liquid droplet spreads after landing on the recording material to come in contact with the ink in the second portion where the liquid and the ink do not overlap each other.

22. A recording method by ejecting ink droplets and liquid droplets for improving a recording quality of the ejected ink on a recording material, comprising the steps of:

obtaining image data to be printed by ink droplets;

obtaining liquid ejection data by thinning out the obtained image data;

ejecting ink onto the recording material on the basis of the image data; and ejecting the liquid onto the recording material on the basis of the liquid ejection data such that the liquid and the ink overlap partially each other, wherein one of said ink ejecting step and said liquid ejecting step are carried out after the other, wherein at the time when both said ink ejection step and said liquid ejecting step are carried out, the number of the ejected ink dots on the recording material by said ink ejecting step is larger than the number of the ejected liquid dots on the recording material by said liquid ejecting step to provide, on the recording material, both a first portion where the liquid and the ink overlap each other and a second portion where the ink is ejected and the liquid and the ink do not overlap each other, wherein the liquid droplet spreads after landing on the recording material to come in contact with the ink in the second portion where the liquid and the ink do not overlap each other.

23. A method according to claim 22, wherein said liquid performs improvement in color development of the ejected ink on the recording material.

24. A recording apparatus for performing recording on a recording material by ejecting ink droplets and liquid droplets for improving a recording quality of the ejected ink on the recording material, comprising:

a first obtaining means for obtaining image data to be printed by ink droplets;

a second obtaining means for obtaining liquid ejection data by thinning out the image data obtained by the first obtaining means;

an ink ejection head for ejecting the ink onto the recording material on the basis of the image data obtained by the first obtaining means;

a liquid ejection head for ejecting the liquid onto the recording material on the basis of the liquid ejection data obtained by the second obtaining means such that the liquid and the ink overlap partially each other;

a first driving signal application means for applying a driving signal to said ink ejection head on the basis of the image data obtained by the first obtaining means; and a second driving signal application means for applying a driving signal to said liquid ejection head on the basis of the liquid ejection data obtained by the second obtaining means, wherein one of said ink ejection head and said liquid ejection head performs respectively ejection after the other, wherein at the time when both said ink ejection head and said liquid ejection head perform ejection, the number of the ejected ink dots on the recording material by said ink ejection head is larger than the number of the ejected liquid dots on the recording material by said liquid ejection head to provide, on the recording material, both a first portion where the liquid and the ink overlap each other and a second portion where the ink is ejected and the liquid and the ink do not overlap each other, wherein the liquid droplet spreads after landing on the recording material to come in contact with the ink in the second portion where the liquid and the ink do not overlap each other.

25. An apparatus according to claim 24, wherein said liquid performs improvement in color development of the ejected ink on the recording material.

* * * * *

UNITED STATES PATENT AND TRADEMARK OFFICE

CERTIFICATE OF CORRECTION

PATENT NO. : 6,206,516 B1
DATED : March 27, 2001
INVENTOR(S) : Jiro Moriyama et al.

It is certified that error appears in the above-identified patent and that said Letters Patent is hereby corrected as shown below:

Column 1,
Line 19, "sing" should read -- using --;
Line 44, "mating" should read -- making --; and
Line 56, "other" should read -- other. --.

Column 2,
Line 47, "s" should read -- is --.

Column 3,
Line 41, "Lo" should read -- to --.

Column 4,
Line 7, "aid" should read -- and --;
Line 67, "(D3 k)" should read -- (Bk) --.

Column 5,
Line 3, "109" should read -- 109. --;
Line 16, "recorded" should read -- recorded. --;
Line 25, "therefore." should read -- therefore, --;
Line 35, "apparatus" should read -- apparatus. --; and
Line 57, "based" should read -- based. --.

Column 6,
Line 22, "medium.." should read -- medium. --; and
Line 62, "employed" should read -- employed. --.

Column 7,
Line 14, "colors" should read -- colors. --;
Line 30, "Is" should read -- is --;
Line 39, "Y." should read -- Y, --; and
Line 40, "fur" should read -- for --.

Column 8,
Line 11, "Y." should read -- Y, --;
Line 26, "read" should read -- red --;
Line 29, "Y." should read -- Y, --;
Line 30, "Y." should read -- Y, --;
Line 31, "Ink" should read -- ink --;
Line 46, "R." should read -- R, --; and
Line 59, "(C)." should read -- (C), --.

UNITED STATES PATENT AND TRADEMARK OFFICE

CERTIFICATE OF CORRECTION

PATENT NO. : 6,206,516 B1
DATED : March 27, 2001
INVENTOR(S) : Jiro Moriyama et al.

It is certified that error appears in the above-identified patent and that said Letters Patent is hereby corrected as shown below:

Column 9,
Line 34, "day" should read -- data --;
Line 47, "ORP" should read -- OMP --; and
Line 62, "(read," should read -- (red, --.

Column 10,
Line 6, "[A1]" should read -- [A1] ¶ Low-molecular component of cation compound --.

Column 11,
Line 32, "headland" should read -- head and --; and
Line 35, "ink" should read -- ink. --.

Column 13,
Line 39, "loaded" should read -- loaded into --; and
Line 42, "command" should read -- commands --.

Column 14,
Line 18, "the a" should read -- the --; and
Line 22, "13" should read -- 13. --.

Column 17,
Line 20, "he ad" should read -- head --; and
Line 33, "had" should read -- head --.

Column 18,
Line 1, "herein' should read -- wherein --;
Line 12, "in" should read -- is --; and
Line 58, "overlay" should read -- overlap --.

Signed and Sealed this

Twelfth Day of March, 2002

*Attest:*

*Attesting Officer*

JAMES E. ROGAN
*Director of the United States Patent and Trademark Office*